US009290354B2

(12) United States Patent
Grill

(10) Patent No.: US 9,290,354 B2
(45) Date of Patent: Mar. 22, 2016

(54) CONTINUOUS FOLDING PROCESS

(75) Inventor: Martin Grill, Mantel (DE)

(73) Assignee: BHS CORRUGATED MASCHINEN-UND ANLAGENBAU GMBH, Weiherhammer (DE)

( * ) Notice: Subject to any disclaimer, the term of this patent is extended or adjusted under 35 U.S.C. 154(b) by 938 days.

(21) Appl. No.: 12/473,614

(22) Filed: May 28, 2009

(65) Prior Publication Data

US 2009/0298661 A1 Dec. 3, 2009

(30) Foreign Application Priority Data

May 29, 2008 (DE) ..... 10 2008 025 890

(51) Int. Cl.
*B65H 45/20* (2006.01)
*B65H 33/02* (2006.01)
*B65H 45/101* (2006.01)

(52) U.S. Cl.
CPC ..... *B65H 45/20* (2013.01); *B65H 33/02* (2013.01); *B65H 45/1015* (2013.01); *B65H 2301/4216* (2013.01); *B65H 2301/42144* (2013.01); *B65H 2701/1768* (2013.01)

(58) Field of Classification Search
CPC .. B65H 45/28; B65H 45/1015; B65H 45/107; B31B 19/86; B31B 2219/9093; B31B 1/25; B31B 17/00; B31B 1/22
USPC ..... 493/357, 227, 59, 68, 204, 355, 463
See application file for complete search history.

(56) References Cited

U.S. PATENT DOCUMENTS

| | | | | |
|---|---|---|---|---|
| 2,729,445 | A * | 1/1956 | Webster | 270/39.05 |
| 2,815,205 | A | 12/1957 | Engstrom | |
| 3,127,029 | A * | 3/1964 | Luginbuhl | 414/798.9 |
| 3,544,099 | A * | 12/1970 | Delaney et al. | 493/418 |
| 3,640,521 | A * | 2/1972 | Hutley | 493/25 |
| 2,657,044 | A | 7/1974 | Apgar | |
| 3,826,348 | A | 7/1974 | Preisig et al. | |
| 4,210,318 | A | 7/1980 | Mehren | |
| 4,268,341 | A * | 5/1981 | Huhne | 156/353 |
| 4,416,653 | A | 11/1983 | Breski et al. | |
| 4,673,382 | A * | 6/1987 | Buck et al. | 493/359 |
| 4,700,939 | A * | 10/1987 | Hathaway | 270/39.02 |
| 4,721,295 | A * | 1/1988 | Hathaway | 270/39.02 |
| 4,846,454 | A * | 7/1989 | Parkander | 270/5.02 |
| 5,088,707 | A * | 2/1992 | Stemmler | 270/39.02 |
| 5,201,700 | A * | 4/1993 | Meschi | 493/415 |
| 5,730,695 | A * | 3/1998 | Hauschild et al. | 493/416 |
| 5,857,395 | A * | 1/1999 | Bohm et al. | 83/408 |
| 6,254,522 | B1 * | 7/2001 | Schmidt | 493/412 |
| 6,336,307 | B1 * | 1/2002 | O'Connor | 53/429 |
| 7,303,524 | B2 * | 12/2007 | Brunow et al. | 493/448 |

FOREIGN PATENT DOCUMENTS

| | | |
|---|---|---|
| DE | 43 05 158 A1 | 8/1994 |
| DE | 195 38 519 A1 | 4/1997 |

(Continued)

*Primary Examiner* — Sameh Tawfik
(74) *Attorney, Agent, or Firm* — Browdy and Neimark, PLLC

(57) ABSTRACT

An installation for folding and stacking an endlessly producible web of corrugated cardboard comprises a folding device for folding a web of corrugated cardboard along predetermined folds and a stacking device which is arranged downstream of the folding device for stacking the web of corrugated cardboard, which has been folded along the folds, in stacks.

8 Claims, 11 Drawing Sheets

(56) References Cited

FOREIGN PATENT DOCUMENTS

| | | | |
|---|---|---|---|
| DE | 102 52 918 | A1 | 5/2004 |
| DE | 103 12 600 | A1 | 10/2004 |
| DE | 10 2004 025 501 | A1 | 12/2005 |
| DE | 10 2007 049 422 | A1 | 4/2009 |
| EP | 1985564 | A2 | 10/2008 |
| IT | BO20070304 | A1 | 7/2007 |
| JP | 59 114263 | A | 7/1984 |

* cited by examiner

CONTINUOUS FOLDING PROCESS

BACKGROUND OF THE INVENTION

1. Field of the Invention

The invention relates to an installation and a method for folding and stacking corrugated cardboard.

2. Background Art

The production of corrugated cardboard usually takes place in a continuous process in which are generated endless webs. After production, these endless webs need to be stored in a suitable form. To this end, they are for instance folded. In particular when folding large-format webs of corrugated cardboard, this may lead to unwanted kinks in the webs.

SUMMARY OF THE INVENTION

It is therefore the object of the invention to provide an installation and a method by means of which the folding and stacking of endless webs of corrugated cardboard is improved.

The gist of the invention is to arrange a folding device and a stacking device at the discharge end of a device for the production of corrugated cardboard. By means of this invention, an endless web of corrugated cardboard can be folded in a continuous production process along predetermined folds and afterwards be piled in stacks.

Features and details of the invention will become apparent from the description of several embodiments by means of the drawings.

DESCRIPTION OF THE PREFERRED EMBODIMENTS

Figure 1:
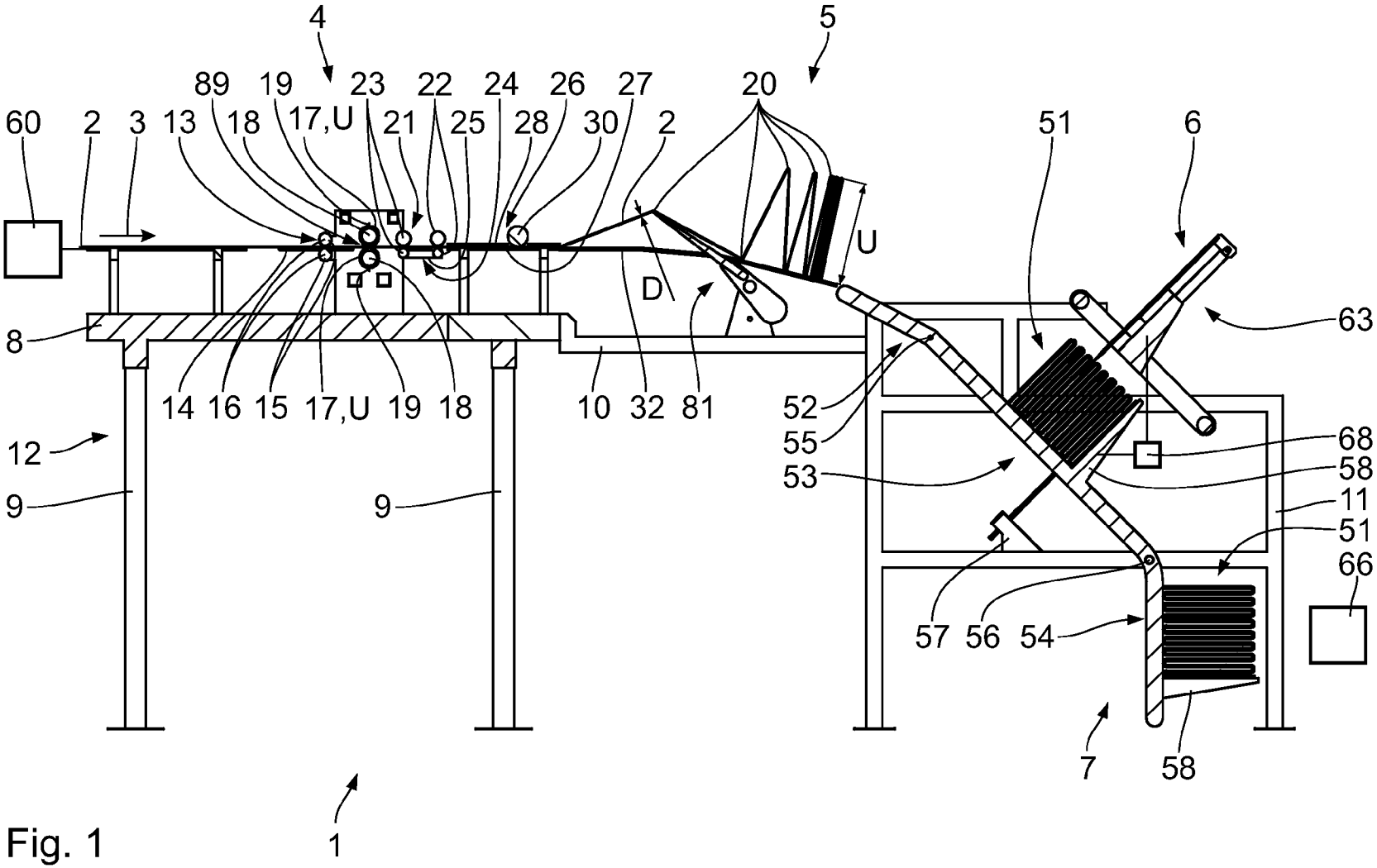
FIG. 1 is a diagrammatic view of an installation for folding stacking and separating webs of corrugated cardboard according to a first embodiment.
Figure 2:
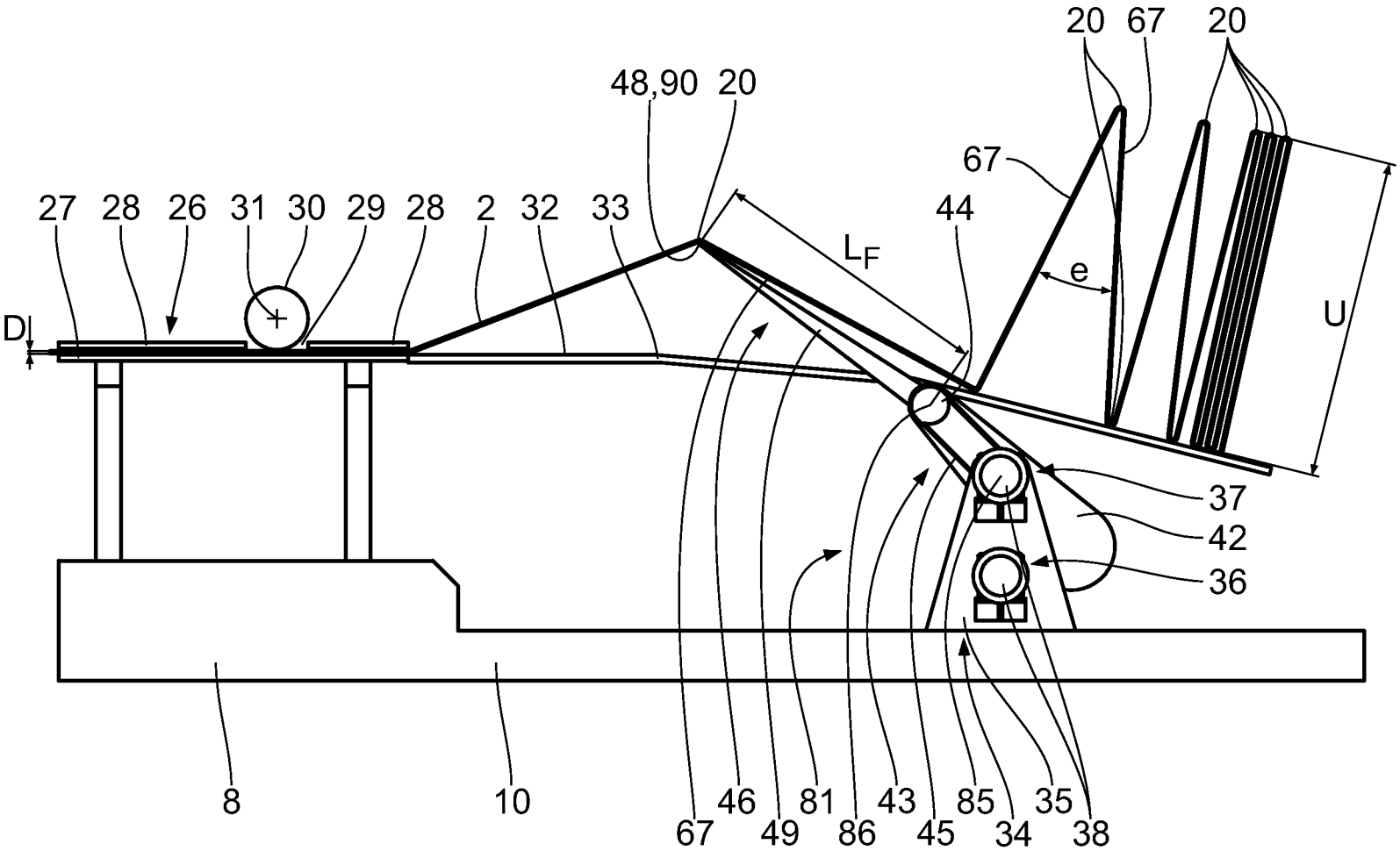
FIG. 2 is a partial cross-section through the installation according to FIG. 1 in the region of the folding device, with the folding device being in a first position.

The following is a description of a first embodiment of the invention with reference to FIGS. 1 to 8. An installation 1 for the embossing, folding, stacking and cutting of endless webs 2 of corrugated cardboard is arranged downstream, relative to a transport direction 3, of a device 60 for the production of corrugated cardboard, with the device 60 only being shown diagrammatically in the Figures. A device 60 of this type is for instance disclosed in DE 103 12 600 A1 to which reference is made. The web 2 of corrugated cardboard, which is produced by means of the device 60, may comprise substantially any desired number of layers. It has a thickness D.

The installation 1 comprises a squeezing device 4, a folding device 5, a cutting device 6 and a stacking device 7. The squeezing device 4 is arranged on a first platform 8 which is rigidly connected to the floor by means of a first frame 9.

Likewise, the folding device 5 is rigidly connected to the floor by means of a second frame 10. Finally, the stacking device 7 is rigidly connected to the floor by means of a third frame 11. Further attached to the third frame 11 is the cutting device 6. The second frame 10 may be connected to the first frame 9 and/or to the third frame 11. The frames 9, 10, 11 form a support framework 12 for the installation 1. The support framework 12 comprising the frames 9, 10, 11 permit a flexible modular layout of the installation 1.

The following is a more detailed description of the squeezing device 4. The squeezing device 4 comprises an insertion portion 13 with a support surface 14. In the region of the feed portion 13 are arranged two feed rollers 15. The feed rollers 15 are cylindrical and in each case mounted for rotation about a feed roller axis 16 which is perpendicular to the transport direction 3. The feed rollers 15 may in particular be drivable for rotation. The squeezing device 4 further comprises at least one pair of embossing rollers 17 which are in each case mounted for rotation about an embossing roller axis 18. The embossing rollers 17 are in particular drivable for rotation by means of a driving device which is not shown in the Figures. The drive is therefore advantageously actuated in intermittent cycles. The embossing roller axes 18 are parallel to each other and perpendicular to the transport direction 3. The embossing roller axes 18 are arranged vertically above each other. The distance between the embossing roller axes 18 is adjustable. Between the surfaces of the embossing rollers 17 is formed a through gap 89 with a free opening. The free opening of the through gap 89 is at least equal to the thickness D of the web 2 of corrugated cardboard. The free opening might be adjusted to the thickness D of the web 2 of corrugated cardboard in such a way that it is just large enough for the embossing rollers to be in frictional contact with the web 2 of corrugated cardboard without however deforming the web 2 of corrugated cardboard when passed through between the embossing rollers 17. The two embossing rollers 17 are at least largely identical. They have a circumference U in the range of 80 cm to 140 cm.

The surface of the embossing rollers 17 is in each case provided with one embossing member 19. The embossing member 19 is blunt and formed in the shape of a bar. It has an extension in the radial direction, in other words perpendicular to the surface of the embossing rollers 17, which is smaller than half of the free opening. The embossing member 19 is continuous. It may however also be in the shape of a rake, in other words it may be provided with gaps in-between. The embossing members 19 of the two embossing rollers 17 are arranged along the circumference of the embossing rollers 17 in such a way that they meet during each revolution of the embossing rollers 17 about the embossing roller axes 18. When the embossing members 19 meet, the free opening of the through-gap 89 is reduced to a value which is smaller than the thickness D of the web 2 of corrugated cardboard. The web 2 of corrugated cardboard is thus squeezable by means of the embossing members 19.

The embossing members 19 are advantageously oriented parallel to the embossing roller axes 18 so as to create folds 20 in the web 2 of corrugated cardboard which are perpendicular to the transport direction 3 and therefore to the longitudinal direction of the web 2 of corrugated cardboard. The distance between two succeeding folds 20 is just equal to the circumference U of the embossing rollers 17. The folds 20 form predetermined bending points in the web 2 of corrugated cardboard along which the web 2 of corrugated cardboard is foldable particularly easily as a bending elasticity thereof is lower in the region of the folds 20 than in the region beyond the folds 20 so that the web 2 of corrugated cardboard bends particularly easily in the region of the folds 20.

Alternatively, it is conceivable to provide only one of the embossing rollers 17 with an embossing member 19. In this case, the circumference U of the embossing roller 17 without embossing member 19 need not fulfill particular requirements. It is virtually freely selectable and may in particular be different from the circumference U of the embossing roller 17 comprising the embossing member 19.

In another embodiment are provided embossing rollers 17 whose circumference U is just equal to an integral multiple of the desired distance between two succeeding folds 20 in the web 2 of corrugated cardboard. The surface of the embossing rollers 17 of this type is provided with a corresponding number of embossing members 19. The embossing members 19 are equally distributed across the circumference U of the embossing rollers 17, in other words the angular distance between in each case two adjacent embossing members 19 is in each case identical. An embossing roller 17, whose circumference U is n-times the distance between two succeeding folds in the web 2 of corrugated cardboard, therefore comprises n embossing members 19 which are in each case arranged at an angular distance of 360°/n on the surface of the embossing roller 17.

The embossing rollers 17 are exchangeable. This allows for easy adjustment of the distance between two succeeding folds 20 in the web 2 of corrugated cardboard, with the distance just being equal to the circumference U of the embossing rollers 17.

Finally, the squeezing device 4 comprises a discharge portion 21 where discharge rollers 22 with discharge roller axes 23 are arranged parallel to the feed roller axes 16. The discharge roller 22 arranged underneath the web 2 of corrugated cardboard is part of a transport unit 24 which further comprises an endless conveyor belt 25.

The folding device 5 is arranged downstream of the squeezing device 4, in other words behind the squeezing device 4 when seen in the transport direction 3. The folding device 5 comprises a double table 26. The double table 26 comprises a lower table top 27 and an upper table top 28. The table tops 27, 28 are parallel to each other. They are spaced from each other in such a way that the web 2 of corrugated cardboard can be passed through between them. To this end, their distance is adaptable to the thickness D of the web 2 of corrugated cardboard.

The upper table top 28 has an oblong opening 29 which is substantially perpendicular to the transport direction 3. In the region of the opening 29, a drive roller 30 is mounted for rotary drive about a drive roller axis 31 in such a way that the web 2 of corrugated cardboard sliding on the lower table top 27 is in tangential contact with the drive roller 30. The drive roller axis 31 is oriented perpendicular to the transport direction 3, parallel to the axes 16, 18, 23.

Seen in the transport direction 3, the double table 26 is adjoined by a contact surface 32 on which the web 2 of corrugated cardboard is slidably disposed in the initial state. The contact surface 32 adjoins the lower table top 27 of the double table 26 in a continuous, stepless manner. The contact surface 32 comprises a bending point 33 from which the contact surface 32 slopes slightly downwards when seen in the transport direction 3. The contact surface 32 may also be curved.

The folding device 5 further comprises a folding unit 81 which is arranged below the contact surface 32. The folding unit 81 comprises a stand 34 which is arranged downstream of the double table 26. Seen in the transport direction 3, the stand 34 is arranged at a distance from the downstream end of the double table 26 which is at least equal to, in particular at least one and a half times, in particular at least twice the distance between two adjacent folds 20 in the web 2 of corrugated cardboard. The stand 34 comprises two retaining members 35 which are arranged opposite to each other when seen perpendicular to the transport direction 3 of the web 2 of corrugated cardboard. On one of the retaining members 35 is disposed a first driving device 36 and a second driving device 37. The driving device 36, 37 comprises in each case one electric motor 38. Via a first belt 39, the electric motor 38 of the first driving device 36 is coupled to a torque transmission member which is configured as a first folding device shaft 40. The first folding device shaft 40 is mounted for rotation about a first axis 85 in the stand 34. The first axis 85 is oriented perpendicular to the transport direction 3, parallel to the axes 16, 18, 23 and 31. It is arranged at a distance $A_1$ from the contact surface 32.

The first folding device shaft 40 is part of a frame 41 which is pivotally mounted in the stand 34 by means of said first folding device shaft 40. The frame 41 further comprises two side parts 42 which are arranged in the end regions of the first folding device shaft 40 and are rigidly connected to the first folding device shaft 40. The side parts 42 are oriented parallel to the transport direction 3. The side parts 42 thus form arms which are perpendicular to the first folding device shaft 40.

In an end region 43 of the side parts 42, an engagement member 46 is mounted for rotation about a second axis 86. The second axis 86 is parallel to the first axis 85. It is arranged at a distance $A_2$ from said first axis 85. The engagement member 46 is coupled to the electric motor 38 of the second driving device 37 by means of a second belt 45 via a second torque transmission member 44. According to the embodiment shown in FIGS. 5 and 6, the second torque transmission member 44 is a stepped belt pulley which is mounted in the frame 41 on one side. On the side of the frame 41 opposite to the belt pulley, the engagement member 46 is mounted in the side part 42 by means of a pin 87. It is generally conceivable as well to provide a second folding device shaft instead of the belt pulley and the pin 87. The engagement member 46 is designed in the manner of a comb. It comprises a crossbar 47 which is oriented along the second axis 86, with a plurality of oblong, finger-shaped projections 49 being connected to said crossbar 47 which taper at their free ends 48 in the manner of the teeth of a comb. Measured from the second axis 86 to their free ends, the projections 49 have a length $L_F$. The length $L_F$ is preferably no greater than the sum of the distance $A_1$ of the first axis 85 from the contact surface 32 and of the distance $A_2$ of the second axis 86 from the first axis 85:

$$L_F \leq A_1 + A_2.$$

By means of the frame 41, the engagement member 46 is pivotable about the first axis 85 in the stand 34 and about the second axis 86 in the frame 41. The engagement member 46 therefore has two degrees of freedom, in particular two degrees of rotational freedom. By varying and adapting the drive characteristics of the engagement member 46 about the two axes 85 and 86 in a suitable manner, a plurality of different web lengths can be folded without having to change the engagement member 46. The engagement member 46 is at least virtually rigid. It is for instance at least partially, in particular fully of metal.

The stand 34 is adjustable in the vertical direction. The relative position of the stand 34 on which the engagement member 46 is held is therefore adjustable relative to the contact surface 32.

The electric motors 38 are actuable by a control unit which is not shown in the Figures. When the electric motors 38 are suitably actuated, the engagement member 46 is movable in such a way that the free ends 48 of the projections 49 may describe a randomly selected trajectory in a folding region about the stand 34, the trajectory being parallel to the transport direction 3. The free ends 48 of the projections 49 are in particular movable along a linear, in other words straight and/or curved path at an angle to the contact surface 32. The web 2 of corrugated cardboard is thus liftable off the contact surface 32 by means of the engagement member 46 of the folding unit 81, with the free ends 48 of the projections 49 forming an interrupted contact edge 90 on which the web 2 of corrugated cardboard is disposed, the contact edge 90 being engageable with the web 2 of corrugated cardboard.

In a region about the stand 34, the contact surface 32 is provided with perforations in the manner of a grating, with the grating being oriented along the transport direction 3 to allow the engagement member 46 to reach through the contact surface 32.

The stacking device 7 with the cutting device 6 is arranged downstream of the folding device 5. The stacking device 7 comprises at least one guide member 50 configured as a slide surface on which stacks 51, which have been folded by the folding device 5, are transported along a predetermined path. The term transport also refers to the automatic sliding of the stacks 51 along the guide member 50 due to the gravitational force. The guide member 50 is arranged at an angle relative to the horizontal, thus forming an inclined plane on which the stack 51 slides. The guide member 50 comprises a first transition portion 52 facing the folding device 5, a cutting portion 53 adjoining the transition portion 52 in the transport direction 3, and a removal portion 54. The abutting portions 52 and 53 as well as 53 and 54 are in each case pivotally interconnected by means of a first joint 55 or a second joint 56, respectively. The portions 52, 53 and 54 have a steepness which increases in the transport direction 3. The guide member 50 therefore has a convex shape. The guide member 50 may in particular also be at least partially curved, in particular in the shape of a segment of a circular arc. This ensures that when depositing the stack 51, the folds 20 abutting the guide member 50 are closer together than folds 20 located outside. This facilitates a damped and precise deposition of the folded stacks 51. The guide member 50 may advantageously be a belt conveyor device comprising a conveyor belt extending across all of the three portions 52, 53 and 54 as well as a drive unit.

The cutting portion 53 is arranged at an angle b relative to the horizontal. The inclination of the cutting portion 53 is adjustable by means of an adjustment member 57. The adjustment member 57 is disposed on the third frame 11. The adjustment member 57 is in particular hydraulically or electrically actuable. In a simpler embodiment, the adjustment member 57 may also be manually operable. An adjustment of the inclination of the cutting portion 53 may be compensated for by pivoting the transition portion 52 relative to the cutting portion 53 by means of the first joint 55 in such a way that the guide member 50 forms a continuous, in other words a substantially stepless transition to the contact surface 32 of the folding device 5, regardless of the inclination of the cutting portion 53. To this end, the transition portion 52 has an adjustable inclination as well.

The stacking device 7 further comprises several stop arms 58. The stop arms 58 serve as end stop and stacking surface for the stacks 51 of corrugated cardboard. The stop arms 58 are displaceable along the guide member 50. The stop arms 58 are oriented perpendicular to the surface of the guide member 50. They are lowerable in a manner known to those skilled in the art, i.e. they are for instance foldable inwardly and outwardly or extendable and retractable.

The removal portion 54 is at least approximately vertical, in particular vertically oriented, in other words it forms an angle c with the horizontal which is in the range of 80° to 90°. A value of the angle c of less than 90° ensures that the stacks 51 of corrugated cardboard reliably abut the guide member 50 even in the region of the removal portion 54, thus preventing the stacks 51 of corrugated cardboard from accidentally sliding off the stop arms 58.

The cutting device 6 is arranged parallel to the cutting portion 53 of the guide member but offset thereto. The cutting device 6 comprises a support structure 61 which is connected to the third frame 11 in such a way as to be pivotable about a support structure axis 62 extending perpendicular to the transport direction 3. Instead of pivotally mounting the support structure 61 to the frame 11, the support structure 61 may alternatively also be connected directly to the stacking device 7, in particular to the cutting portion 53 of the guide member 50 of the stacking device 7. This ensures a particularly simple way of orienting the support structure 61 parallel to the cutting portion 53. A hydraulically operable cutting unit 63 is arranged on the support structure 61. The cutting unit 63 is displaceable on the support structure 61 parallel to the cutting portion 53 of the guide member 50 of the stacking device 7. The cutting unit 63 is advantageously displaceable synchronously with the stop arms 58 which are displaceable along the guide member 50.

The cutting unit 63 comprises a displacement mechanism 64 which is oriented perpendicular to the support structure 61. The displacement mechanism 64 is advantageously a hydraulic cylinder, in particular a single-acting hydraulic cylinder with a spring return member. The hydraulic cylinder may alternatively also be a double-acting hydraulic cylinder. The hydraulic cylinder is advantageously a telescopic cylinder comprising at least 2, in particular at least 3 cylinders which are arranged inside one another. Alternative embodiments of the displacement mechanism 64 are conceivable as well.

On the displacement mechanism 64 is arranged a cutting member 65. By means of the displacement mechanism 64, the cutting member 65 is displaceable perpendicular to the support structure 61 and therefore perpendicular to the cutting portion 53 of the guide member 50.

The displacement mechanism 64 is dimensioned such that the cutting member 65 has a displaceability perpendicular to the support structure 61 which is greater than the maximum expected distance of two adjacent folds 20 in the web 2 of corrugated cardboard. The cutting member 65 has a total length L in the displacement direction perpendicular to the support structure 61. For easy cutting of the web 2 of corrugated cardboard, the guide member 50 is provided with at least one reception groove 88 in a particular region of the cutting portion 53 for receiving the cutting member 65. The reception groove 88 has a depth T which is smaller than the length L of the cutting member 65. In a direction parallel to the surface of the guide member 50, the reception groove 88 has a free opening which is considerably smaller than the thickness of the web 2 of corrugated cardboard.

The cutting member 65 extends in the direction of the support structure axis 62 along the entire width of the web 2 of corrugated cardboard. Seen perpendicular thereto and perpendicular to its longitudinal direction, the cutting member 65 has a thickness S which amounts to no more than 5 cm, in particular less than 3 cm, in particular less than 1 cm. The cutting member 65 is in particular an aluminum cutting plate with a steel cutting blade. The cutting plate advantageously comprises longitudinal holes. The cutting member 65 has a sufficient transverse stiffness, allowing the cutting member 65 to at least temporarily take over the support function of the stop arms 58. The cutting member 65, in particular the blade thereof, is exchangeable. Consequently, the properties of the cutting member 65, in particular the thickness S thereof, are adaptable to the properties of the respectively produced web 2 of corrugated cardboard, for instance to the thickness D, the number of layers and the surface quality thereof. Due to its low thickness S, the cutting member 65 is particularly easily insertable into the stack 51 between two portions of the web 2 of corrugated cardboard which are disposed on top of each other in the stack 51. The support structure 61, which is pivotable about the support structure axis 62, may ensure that by means of the displacement mechanism 64, the cutting member 65 is displaceable parallel to the portions of the web 2 of corrugated cardboard which are disposed on top of each other in the stack 51.

In an alternative embodiment, a stop member is provided instead of the cutting member 65, the stop member being displaceable by means of the displacement mechanism 64. Instead of the cutting blade, the stop member advantageously comprises a groove. In this embodiment, a circular knife is provided for separating the stacks 51 from the upstream web 2 of corrugated cardboard. The circular knife is connected to the third frame 11 by means of a guide. The guide is advantageously a crossbar extending perpendicular to the transport direction 3. A detailed description thereof can be found in paragraph [0021] of DE 10 2007 049 422 A1. When separating the stacks 51 from the upstream web 2 of corrugated cardboard, the circular knife cooperates with the stop member. The circular knife advantageously engages into the groove of the stop member.

Once separated from the web 2 of corrugated cardboard by means of the cutting device 6, the stacks 51 are removable from the removal portion 54 by means of a removal device 66 for further transport and for storage, the removal device 66 only being shown diagrammatically in the Figures.

The following is a description of the function of the installation 1. In the device 60, the webs 2 of corrugated cardboard are produced according to a method which is for instance disclosed in DE 103 12 600 A1. To this end, one or several linerboards are connected to one or several corrugated boards by means of a method which is known to those skilled in the art. A detailed description of this method can for instance be found in DE 43 05 158 A1.

In a first step, the endless web 2 of corrugated cardboard exiting the device 60 is provided with embossings in the squeezing device 4. To this end, the web 2 of corrugated cardboard is passed through between the two embossing rollers 17. After in each case one full revolution of the embossing rollers 17, in other words when the circumference U thereof has rolled off on the web 2 of corrugated cardboard exactly once, the two embossing members 19 meet, thus causing the free opening of the through-gap 89 between the embossing rollers 17 to be reduced to a value $A_{S2}$ which is smaller than the thickness D of the web 2 of corrugated cardboard so that the fold 20 is embossed into the web 2 of corrugated cardboard which is just being passed through between the embossing members 19. To this end, the actuation of the embossing rollers 17 and/or the arrangement of the embossing members 19 on said embossing roller 17 are precisely matched to each other. This applies accordingly if the embossing rollers 17 comprise several embossing members 19. It is apparent that when each embossing roller 17 is provided with n embossing members 19, the web 2 of corrugated cardboard will be provided with n folds 20 per each revolution of the embossing rollers 17. It is generally conceivable as well to provide a sharp-pointed embossing member 19, causing the web 2 of corrugated cardboard passing through the squeezing device 4 to be perforated during each revolution of the embossing rollers 17. What is essential is that web 2 of corrugated cardboard is still in one piece even after passing through the squeezing device 4 in the transport direction 3.

In an alternative embodiment, the actuation of the embossing rollers 17 is independent from the feed speed of the web 2 of corrugated cardboard, and is in particular actuable in intermittent cycles.

By means of the transport unit 24, the embossed web 2 of corrugated cardboard is transported on to the double table 26. In the double table 26, the web 2 of corrugated cardboard is transported on to the contact surface 32 of the folding device 5 by means of the driving roller 30 in such a way as to be protected against deflections perpendicular to the transport direction.

The following is a more detailed description of the folding process in the folding device 5. In the initial state, the web 2 of corrugated cardboard slides on the contact surface 32 in the folding device 5. When the web 2 of corrugated cardboard has been transported in the transport direction 3 at least until at least two folds 20 in the web 2 of corrugated cardboard are disposed in the region between the stand 34 and the discharge end of the double table 26, the engagement member 46 of the folding device 5 is pivoted in the stand 34 by means of the folding device shafts 40, 44 in such a way that the free ends 48 of the projections 49 engage with the web 2 of corrugated cardboard from below, namely exactly in the region of one of the folds 20. The free ends 48 hit the fold 20 with a tolerance of no more than 10 cm, in particular no more than 5 cm, in particular no more than 3 cm. When the free ends 48 hit the fold 20, said fold 20 has advantageously just reached the bending point 33 of the contact surface 32. This facilitates a folding of the web 2 of corrugated cardboard along the folds 20. Furthermore, when the free ends 48 hit the web 2 of corrugated cardboard, the fold 20 that is adjacent to the fold 20, which is in contact with the free ends 48, in the upstream direction is advantageously located at a few centimeters downstream of the downstream end of the double table 26.

When the engagement member 46 is pivoted even further, the web 2 of corrugated cardboard is lifted off the contact surface 32 in the region of the fold 20 by means of the engagement member 46. When this happens, the projections 49 of the engagement member 46 reach through the contact surface 32. During this pivoting movement, the portion of the web 2 of corrugated cardboard in the region of the fold 20 is in contact with the free ends 48 of the projections 49, the free ends 48 forming the contact edge, and is slightly extended in the region between this fold 20 and the down-stream end of the double table. Due to the gravitational force, the web 2 of corrugated cardboard remains in contact with the contact surface 32 in the region of the downstream fold 20 that is adjacent to the fold 20 which is in contact with the contact edge. On the upstream side, the web 2 of corrugated cardboard is held on the contact surface 32 by the double table 26 which prevents a deflection of the web 2 of corrugated cardboard perpendicular to the transport direction 3. The web 2 of corrugated cardboard is thus folded along the fold 20 which is in contact with the contact edge.

The engagement member 46 is pivoted in the stand 34 by means of the driving devices 36 and 37 until the projections 49 form an angle d with the contact surface 32 which for instance amounts to at least 70°, in particular at least 80°. In a particular advantageous embodiment, the projections 49 are designed such that the portion of the web 2 of corrugated cardboard between the fold 20, which is in contact with the free ends 48 of the projections, and the adjacent downstream fold 20 at least largely abuts the projections 49. This prevents the web 2 of corrugated cardboard from sagging in the region between two folds 20.

Figure 3:
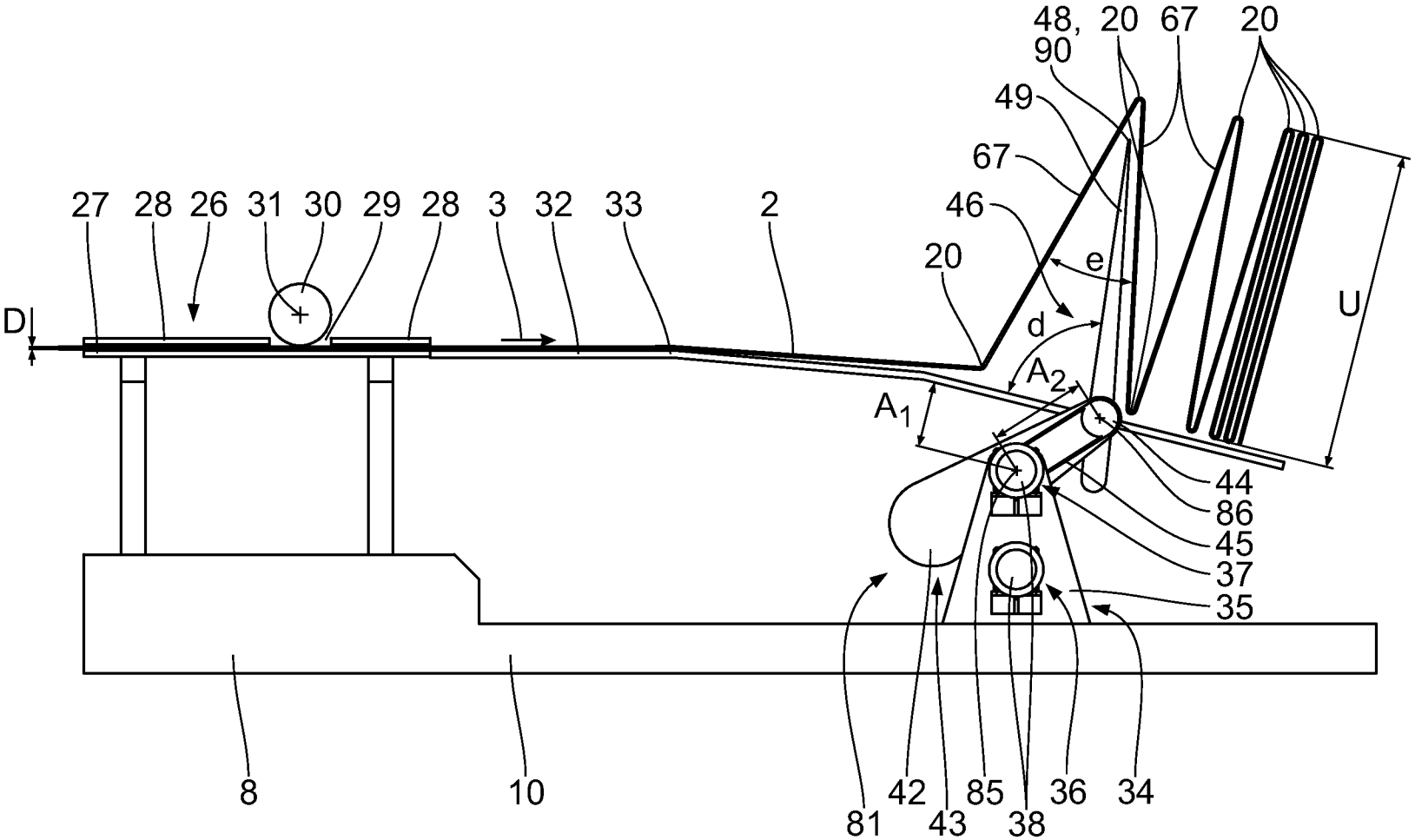
FIG. 3 is a view according to FIG. 2, with the folding device being in a second position.
Figure 4:
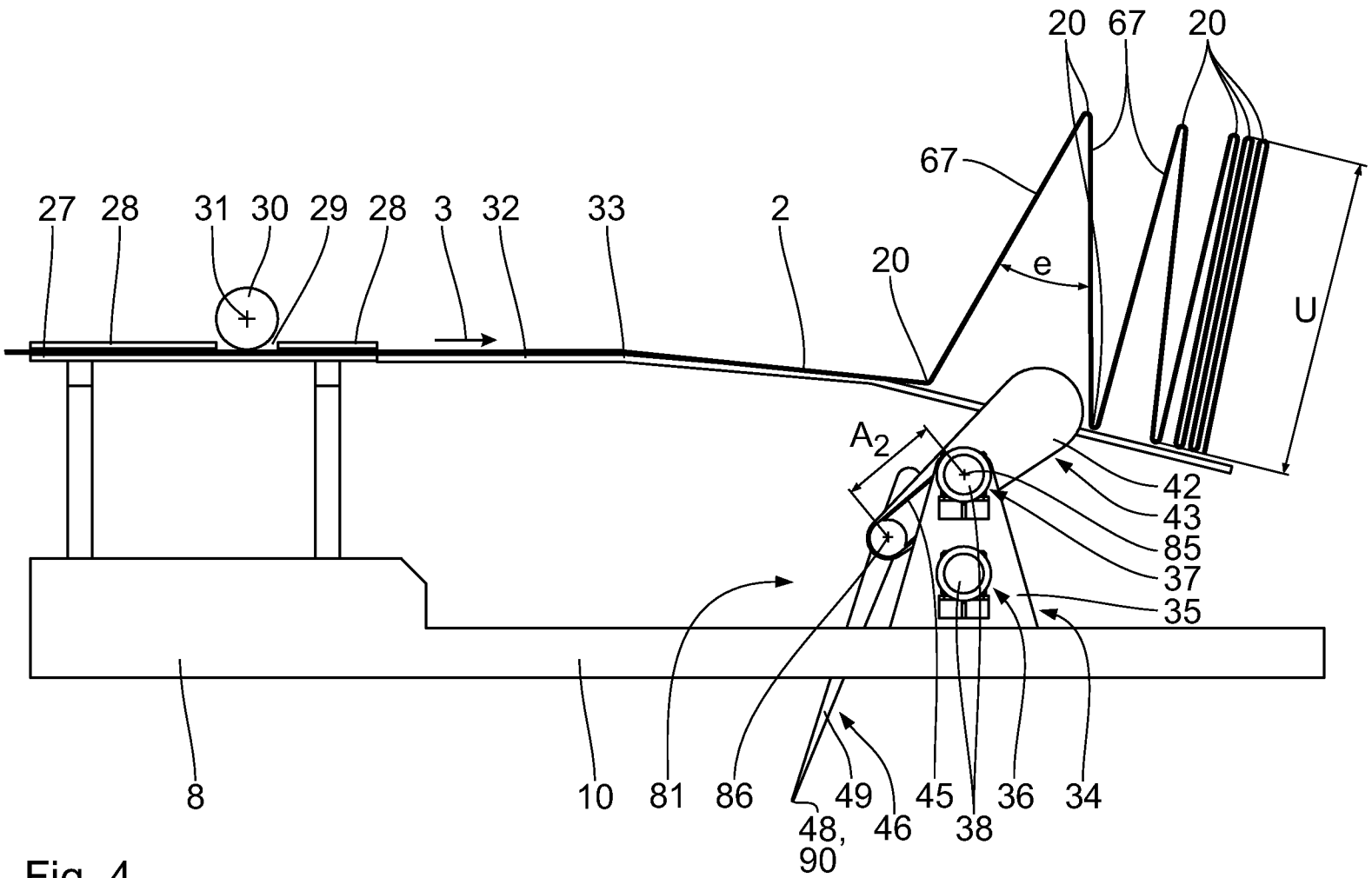
FIG. 4 is a view according to FIG. 2, with the folding device being in a third position.
Figure 5:
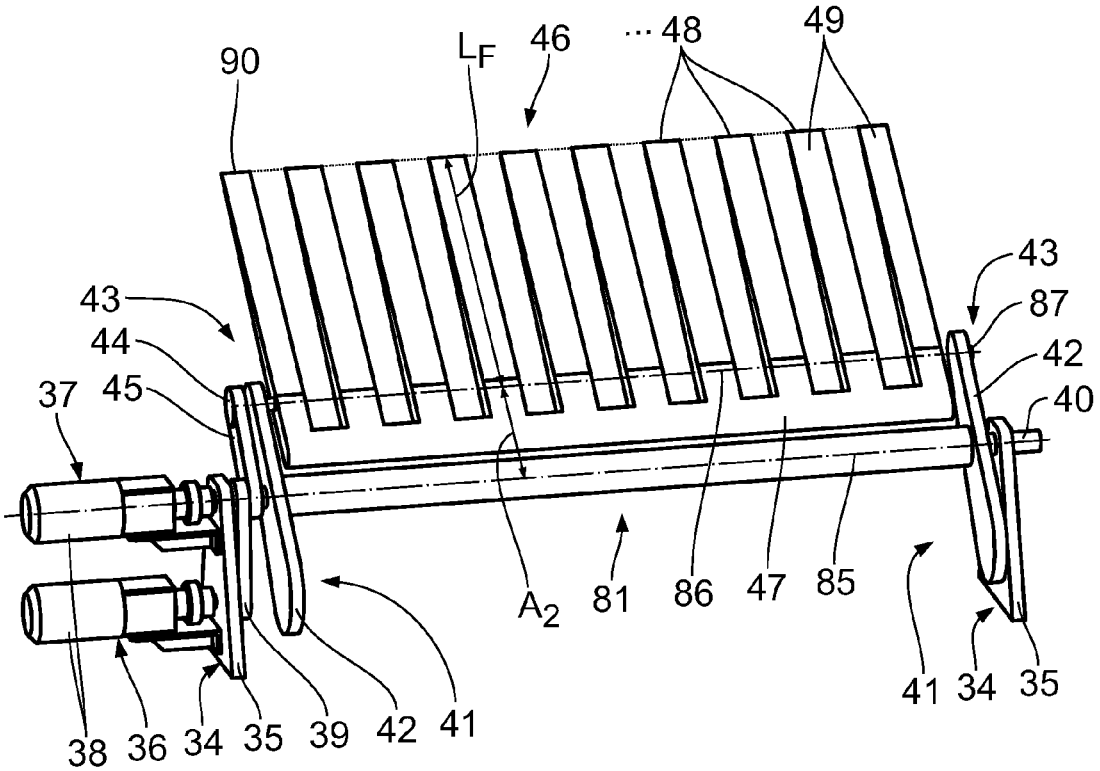
FIG. 5 is a detailed view of the folding device according to the first embodiment.
Figure 6:
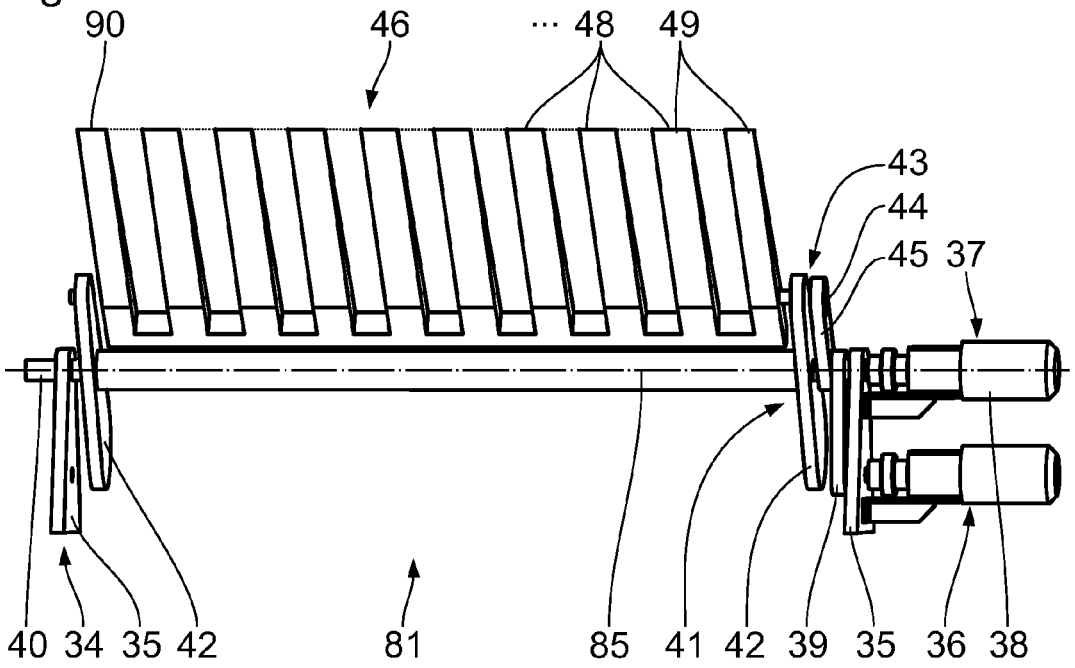
FIG. 6 is another view of the folding device according to FIG. 5.
Figure 7:
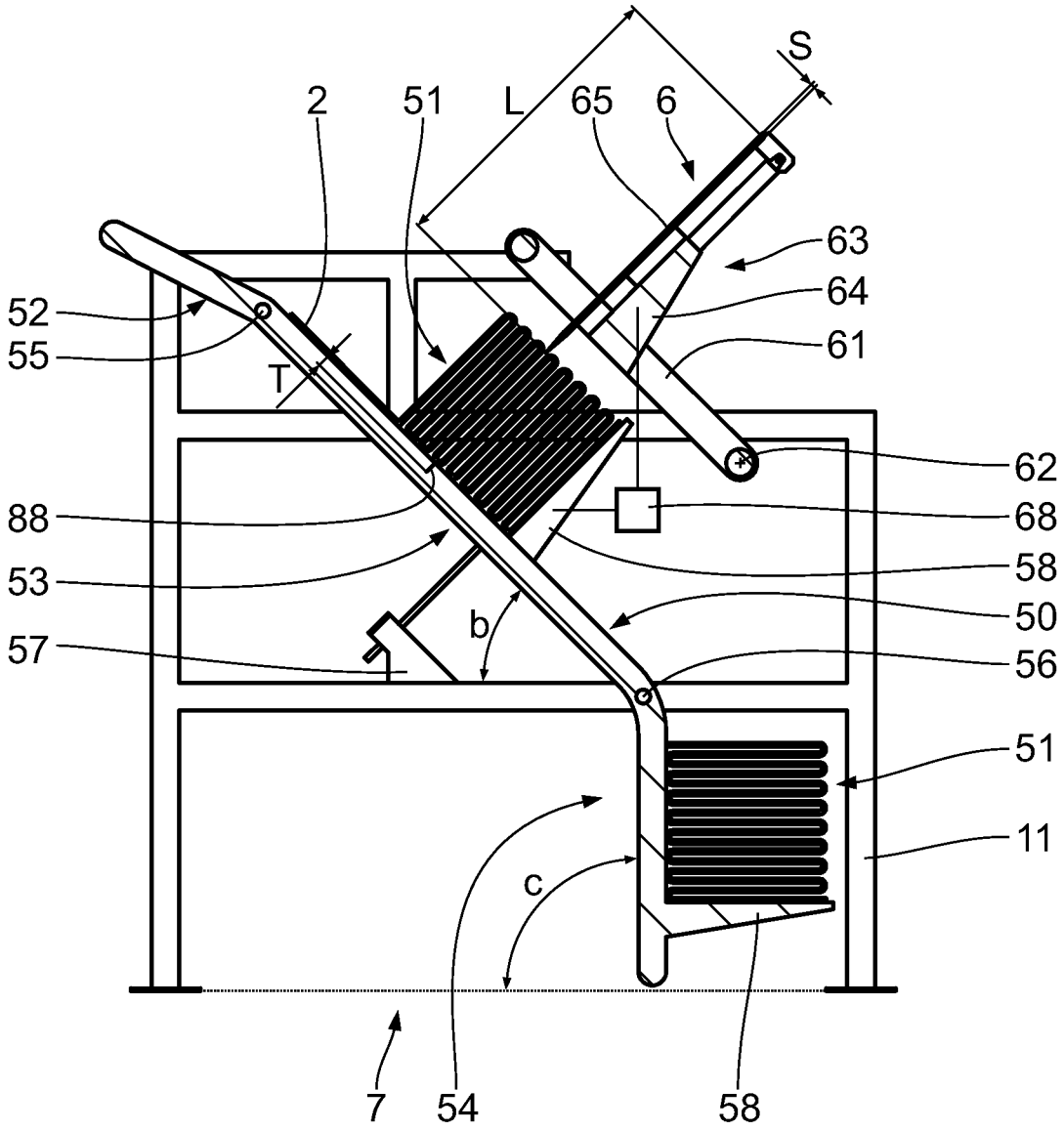
FIG. 7 is a partial sectional view of the installation according to FIG. 1 in the region of the cutting and stacking device, with the cutting device being in a first position.
Figure 8:
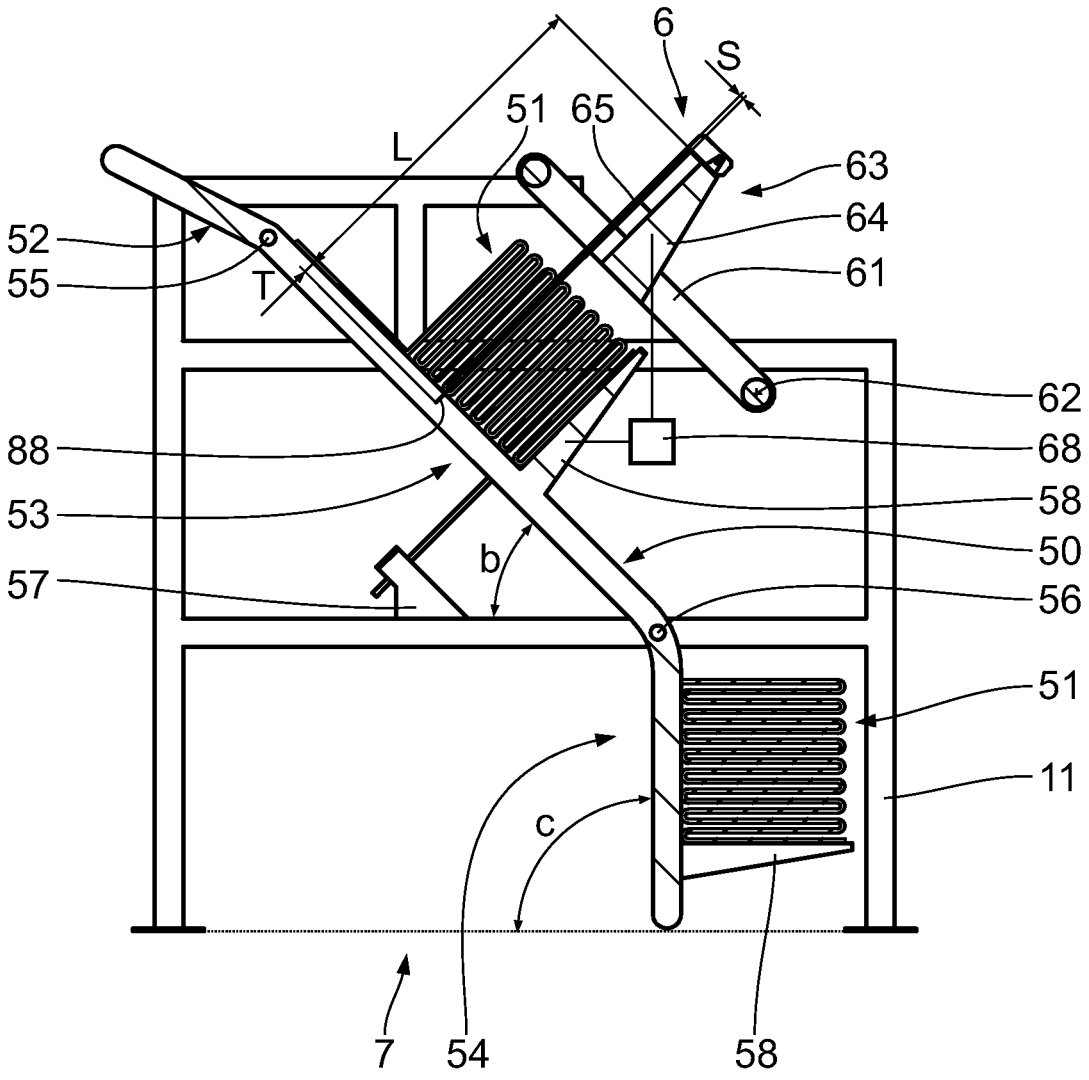
FIG. 8 is a view according to FIG. 7, with the cutting device being in a second position.

In this stage of the folding process shown in FIG. 3, the engagement member 46 is located between two folded portions 67 of the web 2 of corrugated cardboard which are in each case bounded by folds 20 and form an acute angle e of no more than 40°, in particular no more than 20°, at the fold 20 connecting the folded portions 67.

The engagement member 46 is moved down and out of the gap between the folded portions 67 by pivoting the engagement member 46 about the two axes 85 and 86 in a suitable manner. The engagement member 46 is in particular pivoted about the second axis 86 in the frame 41 in a direction opposite to the pivoting direction of the frame 41 about the first axis 85 in the stand 34.

On the downstream end of the folding device 5, the folded web 2 of corrugated cardboard automatically reaches the transition portion 52 of the stacking device 7 due to the gravitational force on the contact surface 32. Due to the increasing inclination of the guide member 50 of the stacking device 7, the folded portions 67 of the folded web 2 of corrugated cardboard are increasingly pressed together when sliding down the guide member 50, causing them to be aligned parallel to each other. As in each case one of the folds 20 bounding the folded portions 67 is in contact with the guide member 50 of the stacking device 7 during the entire stacking process, the stacks 51 are aligned in a very precise, flush manner. A free falling of the folded web 2 of corrugated cardboard, which may result in a reduced precision and, in the worst case, in unwanted kinks, is avoided according to the invention. The in each case lowermost folded portion 67 of a stack 51 is disposed on the stop arms 58 projecting perpendicular to the guide member 50.

The stop arms 58 are displaced along the guide member 50 depending on the size of the stack 51. As soon as a desired number of folded portions 67 is obtained in the stack 51, which may easily be indicated on the guide member 50 by the position of the stop arms 58 on which the stack 51 is disposed, the cutting device 6 is actuated. When this happens, the cutting unit 63 on the support structure 61 is at first moved parallel to the cutting portion 53 of the guide member 50 to the desired position in order to adjust the stack height. The cutting device 6 is advantageously actuated automatically. It is for instance actuated by a control member 68 (only shown diagrammatically in the Figures) which is connected for signal transmission with at least one of the stop arms 58 and the cutting device 6. After triggering the displacement mechanism 64 which is at first in a position in which the cutting member 65 is out of engagement with the stack 51 on the cutting portion 53 of the guide member 50 of the stacking device 7, the cutting member 65 is inserted into the stack 51 between two adjacent folded portions 67 by means of the displacement mechanism 64. The cutting member 65 is displaced parallel to the folded portions 67 by means of the displacement mechanism 64 until the stack 51 in the region of a fold 20 lying on the guide member 50 is separated from the upstream web 2 of corrugated cardboard. The convex shape of the guide member 50 facilitates an insertion of the cutting member 65 between two adjacent folded portions 67. This prevents damage to the web 2 of corrugated cardboard.

The cutting unit 63 is displaced synchronously with the stop arms 58 on which the stack 51 is disposed while the cutting member 65 is being inserted into the stack 51. This avoids unfavorable transverse loads of the cutting member 65.

As soon as the stack 51 is separated from the upstream web 2 of corrugated cardboard, the stack 51 lying on the stop arms 58 is moved at increased speed along the guide member 50 into the removal portion 54. The subsequent upstream stack 51 is temporarily in contact with the cutting member 65 which has separated the web 2 of corrugated cardboard. In other words, the cutting member 65 temporarily takes over the function of the stop arms 58. Meanwhile, further stop arms 58 are provided for placing the next stack 51 onto the guide member 50. In order to support the stack 51, these stop arms 58 are moved along the guide member 50 towards the cutting member 65 on the side thereof opposite to the stack lying on the cutting member 65. Afterwards, the cutting member 65 is retracted from the guide member 50 along the displacement direction by means of the displacement mechanism 64; when it is no longer in engagement with the stack 51, the cutting member 65 is moved back along the support structure 61 into its initial position. In this position, the cutting device 6 is ready for the next cutting process which advantageously takes place without interruption immediately after the preceding cutting process.

The cooperation of the stacking device 7 with the cutting device 6 thus ensures a continuous, interruption-free stacking and cutting of stacks 51 with folded portions 67 of a folded web 2 of corrugated cardboard. In an alternative embodiment, it is provided to displace the stop arms 58 along the guide member 50 in intermittent cycles. In this embodiment, the stop arms 58 stand still during the cutting process, in other words while the cutting member 65 is being inserted into the stack 51. A displaceability of the cutting unit 63 along the support structure 61 can therefore be dispensed with, which reduces the effort required for constructing the cutting device 6.

Once folded and separated from the web 2 of corrugated cardboard, the stacks 51 are removed from the removal portion 54 of the stacking device 7 by means of the removal device 66 for further storage and for transport.

Figure 9:
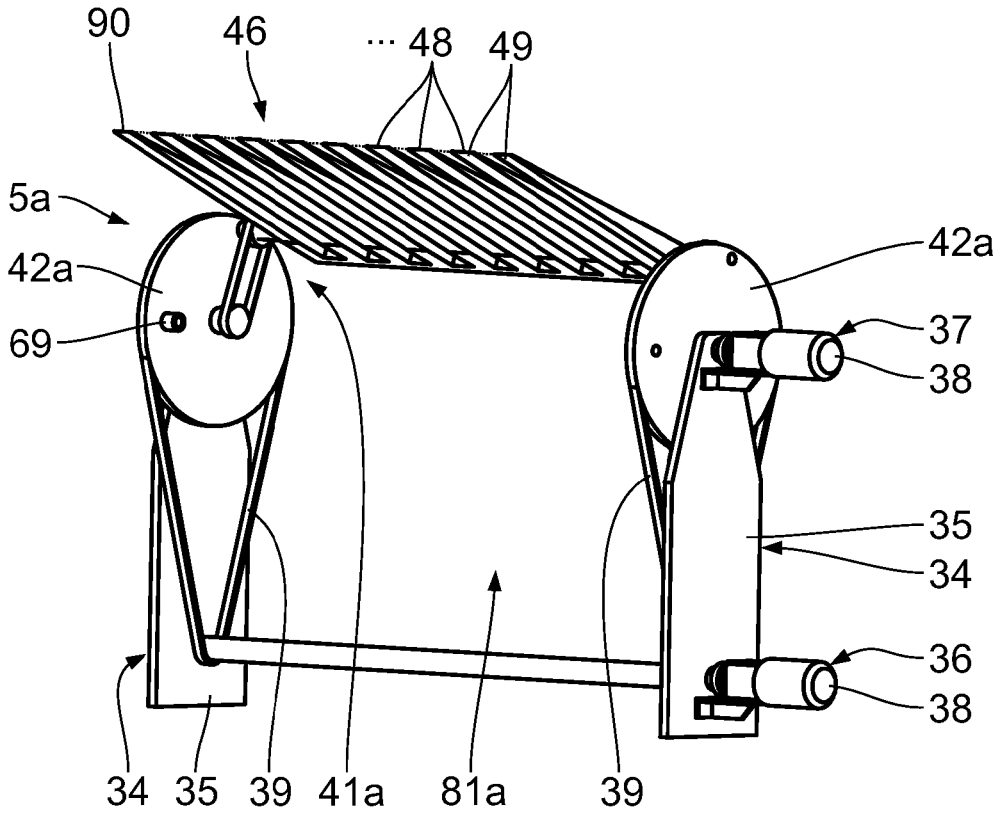
FIGS. 9 to 10 are views according to FIG. 5 and FIG. 6 of a second embodiment of a folding device.
Figure 10:
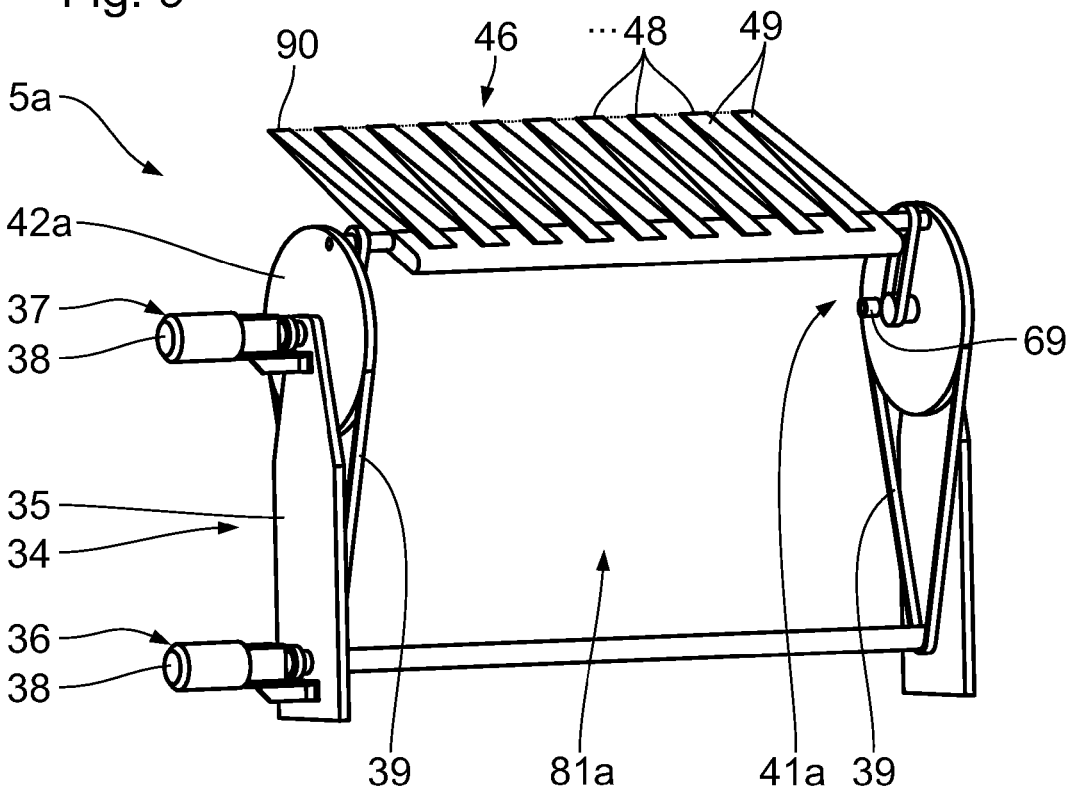

The following is a description of another embodiment of the folding device 5*a* with reference to FIGS. 9 and 10. Identical parts have the same reference numerals as in the first embodiment to the description thereof reference is made. Differently constructed but functionally identical parts have the same reference numerals with a subsequent a. The main difference with respect to the first embodiment is that the side parts 42*a* of the frame 41*a* of the folding unit 81*a* are circular. The second torque transmission member 44 and the pin 87 are mounted at the circumference, in other words eccentrically, in these circular side parts 42*a*. The electric motor 38 of the second driving device 37 on the other hand is arranged in the region of the axis passing through the central points of the circular side parts 42*a*. Moreover, a pin-shaped stop member 69 is provided on the side parts 42*a*. In order to prevent torsional forces, it is advantageous to arrange electric motors 38 and torque transmission members 44 on both sides of the stand 34, in other words on both retaining members 35.

Figure 11:
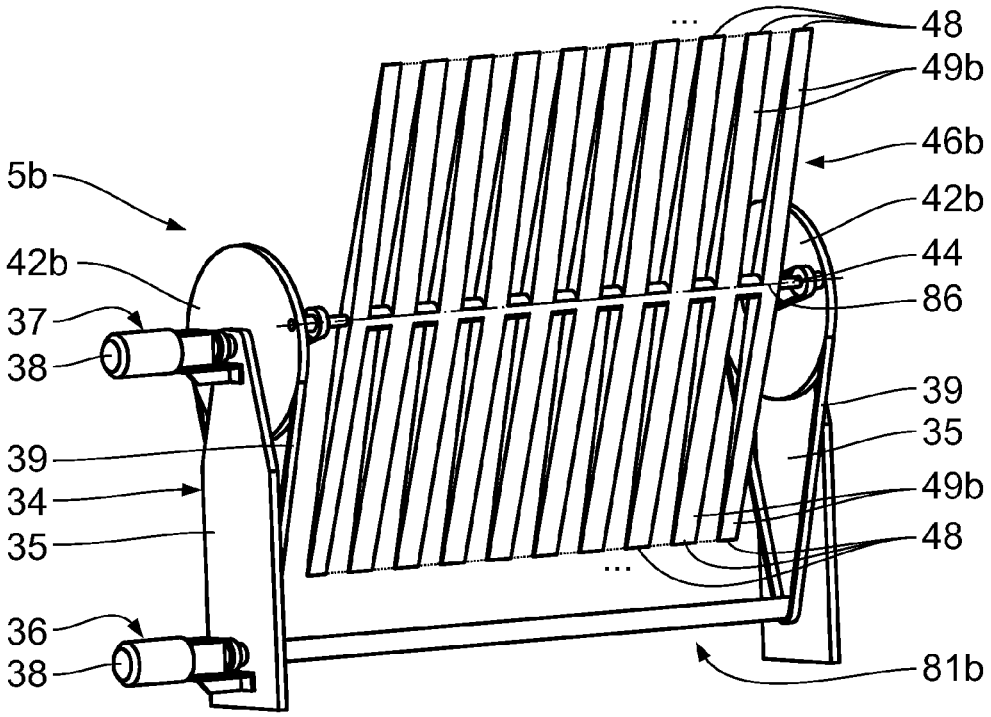
FIGS. 11 to 12 are views according to FIG. 5 and FIG. 6 of a third embodiment of a folding device.
Figure 12:
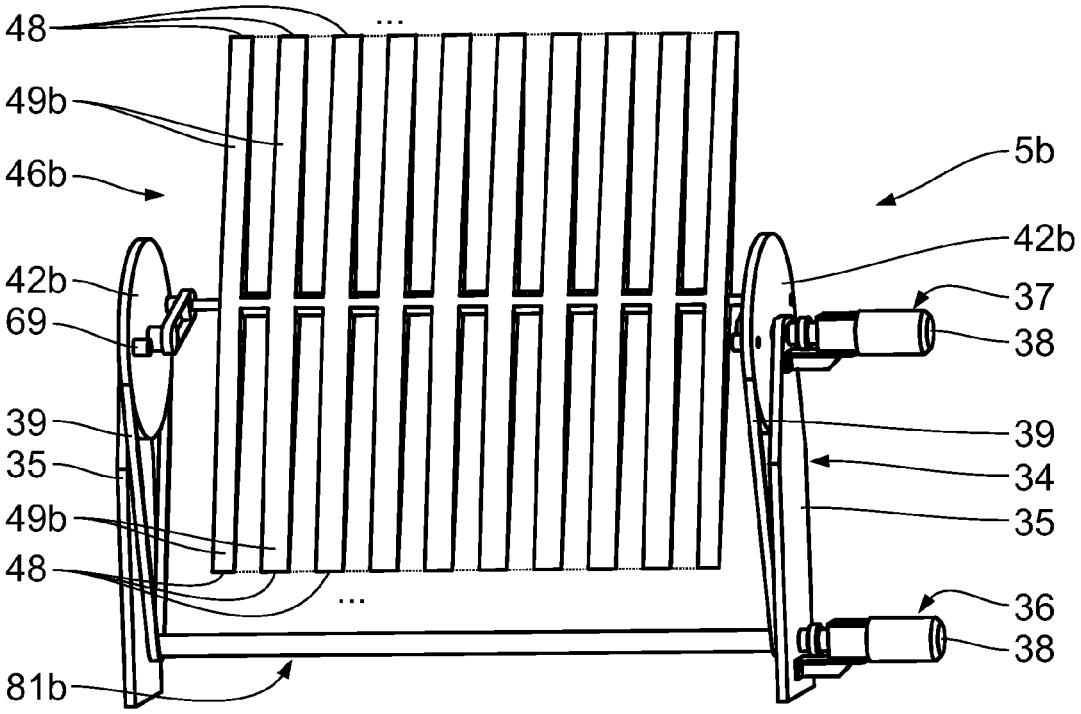

The following is a description of a third embodiment of the folding device 5*b* with reference to FIGS. 11 and 12. Identical parts have the same reference numerals as in the preceding embodiments to the description thereof reference is made. Differently constructed but functionally identical parts have the same reference numerals with a subsequent b. The main difference with respect to the second embodiment is that the engagement member 46*b* of the folding unit 81*b* is symmetric to the second axis 86. The second torque transmission member 44 is advantageously a second folding device shaft in this embodiment. The finger-shaped projections 49*b* extend in each case from the second folding device shaft 44 in opposite directions. The engagement member 46*b* is thus symmetric to the second axis 86. A rotation of the engagement member 46*b* through 180° about the second axis 86 converts the engagement member 46*b* into itself. In other words, the engagement member 46*b* has a plurality of free ends 48 on both sides of the second axis 86 which can be used for folding the web 2 of corrugated cardboard. This reduces the pivoting radius of the engagement member 46*b* required for folding the web 2 of corrugated cardboard, thus reducing in particular the time required for returning the engagement member 46*b* into the initial position, and therefore the time between two folding processes.

Figure 13:
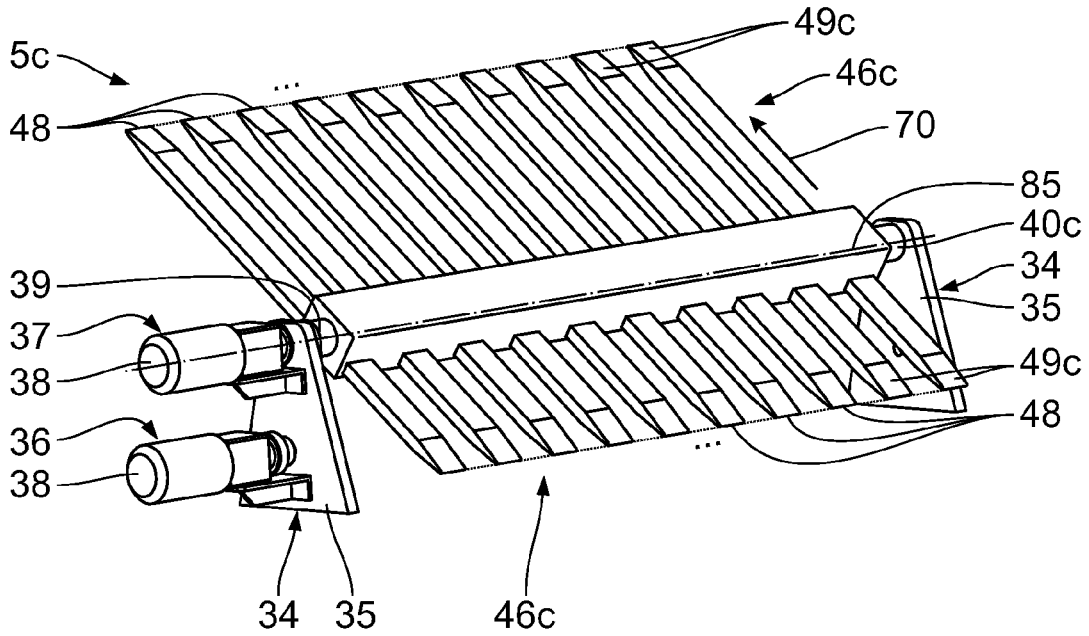
FIGS. 13 to 14 are views according to FIG. 5 and FIG. 6 of a fourth embodiment of a folding device.
Figure 14:
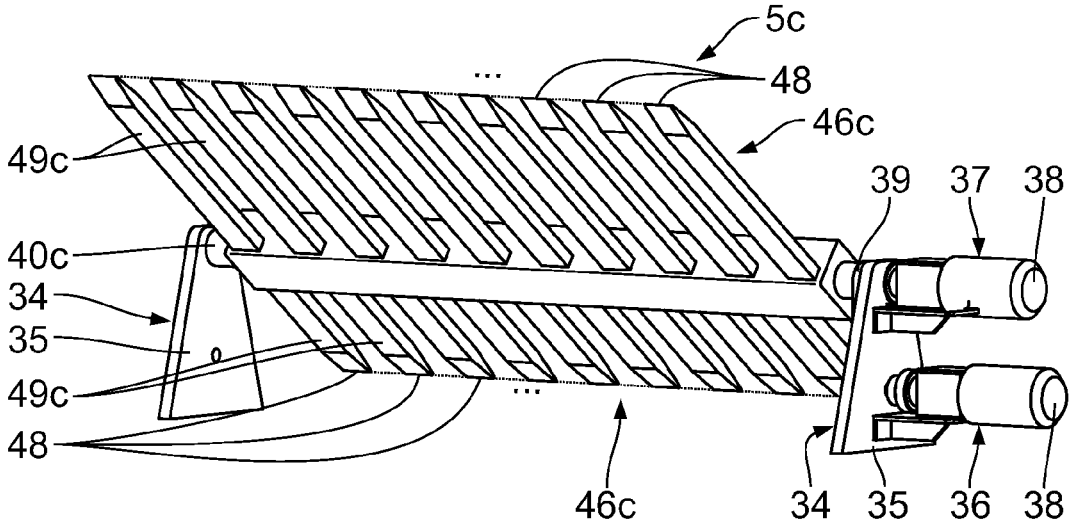

The following is a description of a fourth embodiment of the folding device 5*c* with reference to FIGS. 13 and 14. Identical parts have the same reference numerals as in the first embodiment to the description thereof reference is made. Differently constructed but functionally identical parts have the same reference numerals with a subsequent c. The main difference with respect to the first embodiment is that the folding unit 81*c* comprises only one folding device shaft 40*c* for pivoting the engagement member 46*c* in the stand 34. The engagement member 46*c* has therefore only one degree of rotational freedom. The finger-shaped projections 49*c* are however mounted in the stand 34 for displacement along the folding device shaft 40*c* in and opposite to their longitudinal direction 70. The engagement member 46*c* therefore has an additional degree of translational freedom. A gear mechanism (not shown in the Figures), which is drivable by means of the second electric motor 38, is provided for displacing the projections 49*c* perpendicular to the folding device shaft 40*c*. The finger-shaped projections 49*c* comprise in each case two free ends 48. The free ends 48 have in each case a flat shape. The use of both sides is therefore advantageous. In this embodiment, the length $L_F$ of the finger-shaped projections 49*c* is freely selectable.

Figure 15:
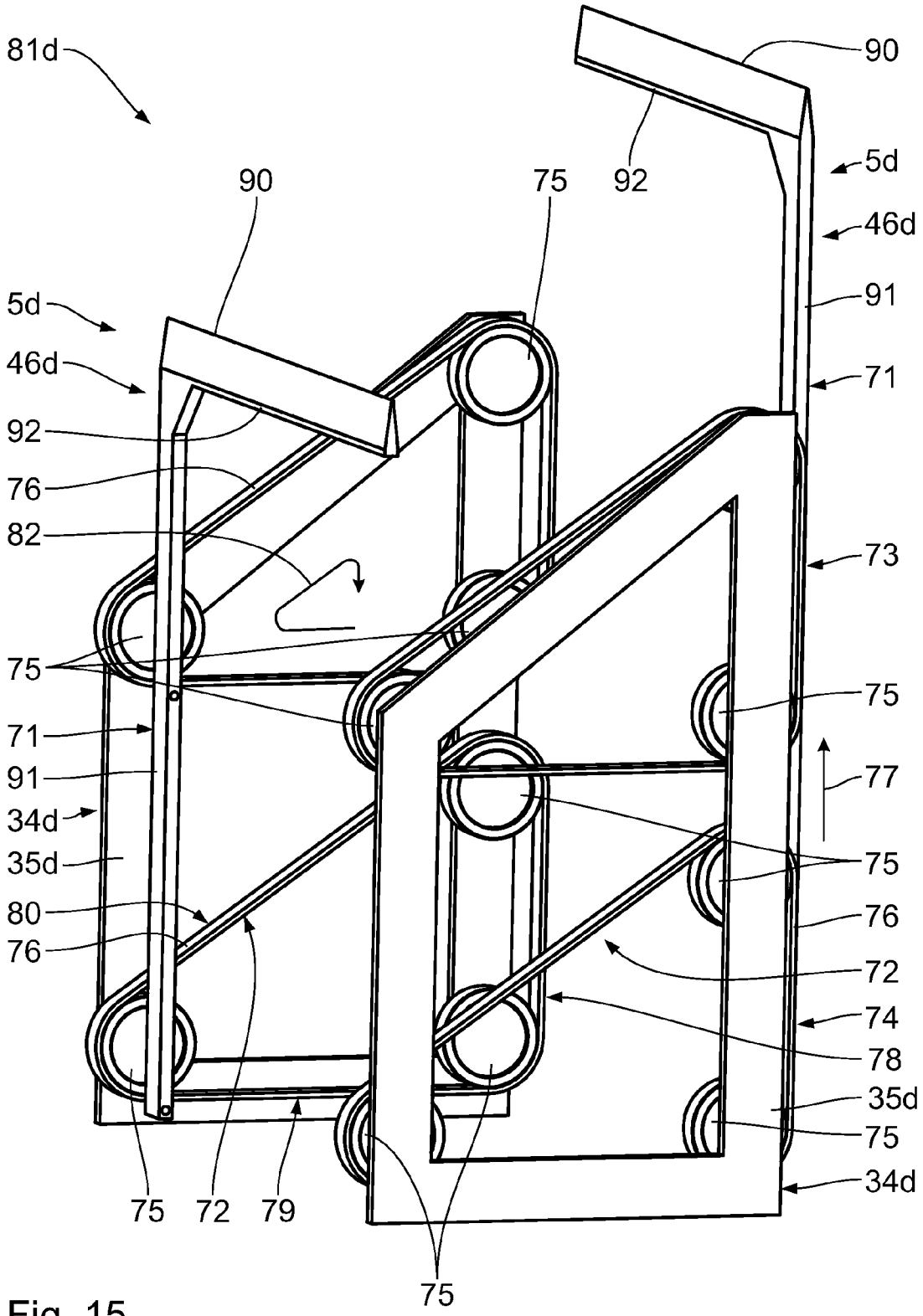
FIG. 15 is a view of a fifth embodiment of a folding device.

The following is a description of a fifth embodiment of the folding device 5*d* with reference to FIG. 15. Identical parts have the same reference numerals as in the first embodiment to the description thereof reference is made. Differently constructed but functionally identical parts have the same reference numerals with a subsequent d. In this embodiment, two engagement members 46*d* are mounted for parallel displacement in the stand 34*d* of the folding unit 81*d*.

The engagement member 46*d* comprises in each case one L-shaped guide arm 71. The L-shaped guide arm 71 comprises two limbs 91, 92 which are perpendicular to each other. The first limb 91 serves for mounting the L-shaped arm 71 to the stand 34*d* while the second limb 92 forms the contact edge 90. The guide arm 71 is in each case connected for displacement with one of the retaining members 35*d* of the stand 34*d* by means of a belt system 72. The retaining members 35*d* of the stand 34*d* are trapezoidal. They are advantageously provided with cut-outs and therefore form only a rigid retaining frame. A solid and/or rectangular design of the retaining members 35*d* is of course conceivable as well.

The belt system 72 comprises an upper partial belt system 73 and a lower partial belt system 74. The lower partial belt system 74 comprises three rolls 75 on each of the two retaining members 35*d*. A belt 76 is in each case passed over the rolls 75. The rolls 75 are mounted for rotation on the stand 34*d*.

At least one of the rolls 75 on each of the retaining members 35*d* is drivable for rotation. The rolls 75 on the two retaining members 35*d* of the lower partial belt system 74 are in particular synchronized with each other. The driving device 36, which is not shown in FIG. 15, is provided for driving the rolls 75. The driving speed of the lower partial belt system 74 is equal to that of the upper partial belt system 73. The partial belt systems 73, 74 are advantageously driven synchronously. Their driving speed is adaptable to the feed speed of the web 2 of corrugated cardboard. The lower partial belt system 74 comprises a vertical portion 78, a horizontal portion 79 and a diagonal portion 80.

The upper partial belt system 73 is parallel to the lower partial belt system 74 but offset relative thereto in an offset direction 77, in particular in the vertical direction. It is at least largely identical to the lower partial belt system 74 to the description thereof reference is made.

Two points of the guide arm 71 are connected to in each case one of the belts 76 of the upper partial belt system 73 and to one of the belts 76 of the lower partial belt system 74. As a result, each guide arm 71 is in each case connected to one of the retaining members 35*d* by means of the upper and lower partial belt system 73, 74 via points disposed vertically above one another, thus ensuring that the guide arm 71 is mounted in the stand 34*d* in a tilt-free, parallelly displaceable manner. The engagement members 46*d* are movable past each other when displaced in the stand 34*d* by means of the belt system 72.

The connection points between the guide arm 71 and the belt system 72 are oriented such that the engagement member 46*d* is oriented parallel to the offset direction 77. By means of the belt system 72, the engagement member 46*d* is cyclically displaceable along the vertical portion 78, the horizontal portion 79 and the diagonal portion 80 in a first direction of rotation 82.

The folding unit 81*d* is advantageously arranged such that the contact edge 90 is disposed slightly below the web 2 of corrugated cardboard, in particular slightly below the contact surface 32 when the engagement member 46*d* is displaced along the horizontal portion 79.

In this embodiment, the folding device 5*d* may comprise a second folding device 81*d* which is arranged above the web 2 of corrugated cardboard. The second folding unit 81*d* is mirror-symmetric to the folding unit 81*d* which will hereinafter be referred to as first folding unit 81*d*. The symmetry plane is horizontal. The second folding unit 81*d* is arranged above the web 2 of corrugated cardboard in such a way that the lowest point of the contact edge 90 is disposed just above the contact surface 32 and presses the web 2 of corrugated cardboard against the contact surface 32. The second folding unit 81*d* is height-adjustable in the vertical direction as well. The second folding unit 81*d* is at least slightly arranged offset relative to the first folding unit 81*d* when seen in the transport direction 3 of the web 2 of corrugated cardboard. It is in particular arranged downstream of and adjacent to the first folding unit 81*d*. Alternatively, an overlapping arrangement of the folding units 81*d* may be advantageous as it results in an improved folding of the web 2 of corrugated cardboard.

The belt systems 72 of the folding units 81*d* are synchronized with each other.

For folding the web 2 of corrugated cardboard, the contact edge 90 of the engagement member 46*d* of the first folding unit 81 is brought into engagement with one of the folds 20 in the web 2 of corrugated cardboard from below. A suitable control device ensures that the contact edge 90 comes into engagement with in each case one of the folds 20.

Afterwards, the engagement member 46*d* is displaced obliquely parallel to the contact surface 32 along the diagonal portion 80 by means of the belt system 72. This causes the web 2 of corrugated cardboard to be lifted and folded down in the region of the fold 20 lying on the contact edge 90. At the same time, the engagement member 46*d* of the second folding unit 81*d* is displaced obliquely downwards along the diagonal portion 80. When this happens, the contact edge 90 comes into engagement with the fold 20 in the web 2 of corrugated cardboard which is adjacent to the fold 20 in the downstream direction and lies on the contact edge 90 of the first folding unit 81*d*, thus ensuring that this fold 20 is in contact with the contact surface 32. As a result, the web 2 of corrugated cardboard is precisely folded along the folds 20, namely alternately up and down.

When the engagement members 46*d* are displaced along the vertical portions 78, the limbs 92 of the folding units 81*d* are in each case removed from the region between two folded portions 67.

Finally, the engagement members 46*d* of the folding units 81*d* are returned to their initial positions along the horizontal portions 79.

What is claimed is:

1. An installation for continuous embossing, folding, stacking and cutting an endlessly producible web (2) of corrugated cardboard, the installation comprising:

a folding device (5; 5*a*; 5*b*; 5*c*; 5*d*) for folding an uncut web (2) of corrugated cardboard along predetermined folds (20);

a stacking device (7) arranged downstream of the folding device (5; 5*a*; 5*b*; 5*c*; 5*d*) for stacking the uncut web (2) of corrugated cardboard, which has been folded along the folds (20), in stacks (51), wherein the stacking device (7) comprises at least one guide member (50) for precisely aligning the stacks (51); wherein the at least one guide member (50) comprises a cutting portion (53), wherein that cutting portion (53) is arranged at an angle (b) relative to the horizontal, and wherein an inclination of the cutting portion (53) is adjustable by an adjustment member (57);

a squeezing device (4) provided upstream of the folding device (5; 5*a*; 5*b*; 5*c*; 5*d*) for embossing folds (20) into the uncut web (2) of corrugated cardboard;

a cutting device (6) arranged downstream of the folding device (5; 5*a*; 5*b*; 5*c*; 5*d*) and disposed in a position opposite to the cutting portion (53), the cutting device (6) cuts completely through the folded and stacked uncut web (2) that is gathered adjacent and resting on the cutting portion (53) of the guide member to form separate individual sheets;

wherein the installation (1) is arranged downstream, relative to a transport direction (3) of a device (60) for the production of endless webs (2) of corrugated cardboard;

wherein the cutting device (6) comprises a cutting unit (63) which comprises a displacement mechanism (64), wherein a cutting member (65) is arranged on the displacement mechanism (64);

wherein after triggering the displacement mechanism (64) which is at first in a position in which the cutting member (65) is out of engagement with the stack (51) on the cutting portion (53) of the at least one guide member (50), the displacement mechanism (64) inserts the cutting member (65) into the stack (51) between two adjacent folded portions (67); and wherein the at least one guide member (50) is a slide surface on which stacks (51), which have been folded by the folding device (5), are transported along a predetermined path.

2. An installation according to claim 1, wherein the folding device (5; 5*a*; 5*b*; 5*c*; 5*d*) comprises at least one engagement member (46; 46*b*; 46*c*; 46*d*) with finger-shaped projections (49).

3. An installation according to claim 2, wherein the engagement member (46; 46*b*; 46*c*) comprises at least two degrees of freedom.

4. An installation according to claim 1, wherein the at least one guide member (50) comprises an adjustable inclination in at least a portion thereof.

5. An installation according to claim 1, wherein the at least one guide member (50) is arranged at an angle relative to the horizontal, thus forming an inclined plane on which the stack (51) slides.

6. An installation according to claim 1, wherein the at least one guide member (50) has a convex shape.

7. An installation according to claim 1, wherein the adjustment member (57) is hydraulically or electrically actuable.

8. An installation according to claim 1, wherein the guide member comprises an inclined surface and a horizontal surface, the inclined surface being before the cutting portion and the horizontal surface being after the cutting portion in the moving direction of the corrugated cardboard, the inclined surface and the cutting portion having different angles of inclination.

* * * * *